US006167853B1

(12) United States Patent
Letsche

(10) Patent No.: US 6,167,853 B1
(45) Date of Patent: Jan. 2, 2001

(54) HYDRAULIC CONTROL DEVICE FOR AT LEAST ONE LIFTING VALVE

(75) Inventor: Ulrich Letsche, Stuttgart (DE)

(73) Assignee: DaimlerChrysler AG, Stuttgart (DE)

( * ) Notice: Under 35 U.S.C. 154(b), the term of this patent shall be extended for 0 days.

(21) Appl. No.: 09/403,167

(22) PCT Filed: Mar. 20, 1998

(86) PCT No.: PCT/EP98/01630

§ 371 Date: Mar. 22, 2000

§ 102(e) Date: Mar. 22, 2000

(87) PCT Pub. No.: WO98/48151

PCT Pub. Date: Oct. 29, 1998

(30) Foreign Application Priority Data

Apr. 17, 1997 (DE) ..... 197 16 042

(51) Int. Cl.[7] ..... F01L 9/02
(52) U.S. Cl. ..... 123/90.12; 123/198 D
(58) Field of Search ..... 123/90.12, 90.13, 123/90.15, 198 D

(56) References Cited

U.S. PATENT DOCUMENTS 5,193,495 * 3/1993 Wood III ..... 123/90.12
5,221,072 6/1993 Erickson et al. ..... 251/30.05
5,595,148 * 1/1997 Letsche et al. ..... 123/90.12
5,680,841 * 10/1997 Hu ..... 123/322
5,713,315 * 2/1998 Jyoutaki et al. ..... 123/90.12

FOREIGN PATENT DOCUMENTS 195 01 495 11/1995 (DE) .

* cited by examiner

*Primary Examiner*—Weilun Lo
(74) *Attorney, Agent, or Firm*—Evenson, McKeown, Edwards & Lenahan, P.L.L.C.

(57) ABSTRACT

The invention relates to a hydraulic control device for a lifting valve, the said device comprising a valve stem capable of being moved by two spring means acting in opposition to one another, the valve stem being capable of being activated hydraulically in the region of its end positions. According to the invention, the hydraulic control device contains a hydraulically regulatable spring means which is assigned a hydraulically acting auxiliary control member, by means of which the working fluid of the hydraulically regulatable spring means can be relieved of pressure.

4 Claims, 4 Drawing Sheets

HYDRAULIC CONTROL DEVICE FOR AT LEAST ONE LIFTING VALVE

This application claims the priority of PCT/EP98/01630, filed Mar. 20, 1998 and 197 16 042.5, filed Apr. 17, 1997, the disclosure of which is expressly incorporated by reference herein.

BACKGROUND OF THE INVENTION

The present invention relates to a hydraulic control device for at least one lifting valve, and more particularly to a hydraulic control device having a valve stem associated with a first spring for loading in a valve-closing direction and a second hydraulically regulatable spring for loading in a valve-opening direction, and which is connected to a control piston arranged to be loaded hydraulically on two sides thereof, an operation of closing or opening the at least one lifting valve being capable of being triggered by an actuator of a central control unit.

DE 195 01 495 C1 discloses a valve control which guides a linearly moveable lifting valve. The valve control has a valve stem on which a helical compression spring acts in the valve-closing direction and an oil-pressure spring temporarily acts in the valve-opening direction. The valve control further has a control piston which is connected to the valve stem, is arranged in a working space, is capable of being loaded with a working fluid and which, in the region of each of its end positions, partially delimits a plunging space belonging to the working space and capable of being separated hydraulically from the latter. When the control piston has plunged into one of its plunging spaces, that is to say is located in the region of its end position, the plunging space is relieved of pressure, with the result that the pressure in the working space causes this valve position to be stabilized. If, however, the control piston and therefore the valve stem remain standing in an undefined middle position due to a malfunction, resetting and the elimination of this malfunction are possible only in a very complicated way.

SUMMARY OF THE INVENTION

An object of the present invention is to provide a control device by which malfunctions can be compensated simply.

This object has been achieved according to the invention by providing that the second hydraulically regulatable spring means is assigned a hydraulically acting auxiliary control member which, in the event of an actuating operation of the actuator in the closing direction of the at least one lifting valve, relieves the second hydraulically regulatable spring means of pressure to below the actuating force of the first spring means. Consequently, the pressure of the second hydraulically regulatable spring means can be lowered separately and quickly until the compressive force of the first spring device predominates over that of the second hydraulically regulatable spring device. When the lifting valve is in any position, therefore, a movement for resetting the latter can be triggered by activating the auxiliary control member, without a reduction in the supply pressure having to be carried out. The auxiliary control member may be activated directly together with the activation of the actuator or indirectly as a result of the activation of the actuator and by virtue of the resulting actuating operation. This activation may take place mechanically, electronically, electrically, electromagnetically or pneumatically, as required, but preferably hydraulically. In the last-mentioned case, activation is preferably carried out via the same actuator which makes it possible to activate the control piston.

In an advantageous embodiment of the invention, the auxiliary control member has a 2/2-way valve function. This function can be implemented by particularly simple apparatus within the framework of the existing hydraulic system.

In an advantageous embodiment of the invention, the auxiliary control member is connected via control lines to a pressure supply line and a pressure relief line which are capable of being loaded by the actuator. The connection of the auxiliary control member to the existing hydraulic system can thereby be made particularly simply.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
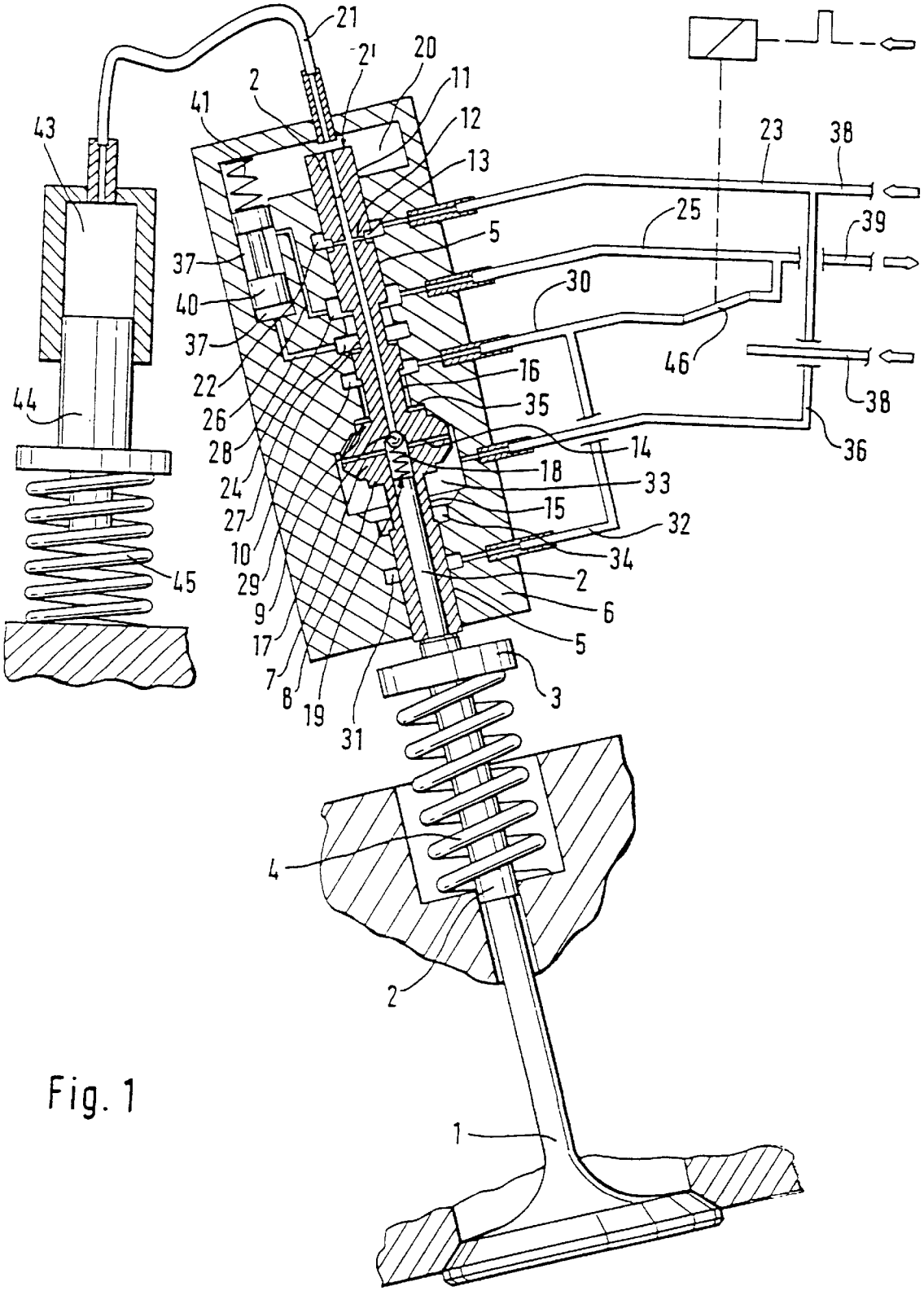
FIG. 1 is a cross-sectional view of an embodiment of a hydraulic control device according to the invention for a linearly moveable lifting valve of an internal combustion engine, with a helical compression spring acting in the valve-closing direction and with a combination of a helical compression spring and an oil-pressure spring, the combination acting in the valve-opening direction when the lifting valve is in a closing position.

An internal combustion engine, particularly for driving a motor vehicle, has, in a way known per se, a plurality of cylinders. The combustion spaces of the cylinder are each provided with at least one lifting valve for the supply of a fuel/air mixture of the discharge of the exhaust gas. The lifting valves are controlled by engine electronics serving as a central control unit. According to FIGS. 1 to 4, a hydraulic control device, described in more detail below, is provided for activating each lifting valve 1.

Each lifting valve 1 has a valve stem 2 and a spring receptacle 3 fixedly connected to the latter. The valve stem 2 is loaded via the spring receptacle 3, by way of a prestressed compression spring 4 serving as a first spring device, in the valve-closing direction with a force which holds the lifting valve 1 in its position of rest illustrated in FIG. 1.

The valve stem 2 is mounted in a linearly displaceable manner with a piston region in a cylinder guide 5 which is an integral part of the housing 6. The cylinder guide 5 is widened at one point to form a working space 33, through which the piston region of the valve stem 2 passes. The piston region has, in the working space 33, a control piston 7 which, in the embodiment illustrated, is connected in one piece to the valve stem 2. The control piston 7 has a lower and an upper plunger piston 8, 9 which each plunge into respective pressure spaces 34, 35 in the region of an end position of the valve stem 2. The pressure spaces 34, 35 are configured in such a way that, when the valve stem 2 is in the end positions, they are in each case separated hydraulically from the remaining volume of the working space 33 by the plunger pistons 8, 9.

The working space is part of a hydraulic system, described in more detail below, the pressure of which is controlled via at least one hydraulic pump, not illustrated, by corresponding supply lines 38 serving for pressure build-up and by a return line 39 serving for pressure relief. Moreover, the pressure build-up and pressure relief in the hydraulic system are controlled via an electromagnetic switching valve 46 which serves as an actuator and which is activated by corresponding switching signals from the engine electronics.

In order to load the piston region of the valve stem 2 hydraulically, altogether five annular ducts 22, 24, 27, 29, 31 are provided, distributed over the length of the piston region, in the cylinder guide. Four annular ducts 22, 24, 27, 29 are arranged above the control piston 7 and therefore above the working space 33, and a further annular duct 31 is arranged below the working space 33. The annular duct 22 is connected directly to the supply line 38, while the annular ducts 29, 31 are capable of being connected either to the further supply line 38 or to the return line 39 via connecting lines 30, 32 and a branch point of the electromagnetic switching valve 46. The branch point is in the form of railway points. The annular duct 27 is connected to a control slide 40 via a control line 28 for activating an auxiliary control member in the form of a 2/2-way valve. The annular duct 24 is connected, on one hand, via a connecting line to the return line 39 and, on the other hand, via a control line 26 to a working space of the control slide 40 of the 2/2-way valve 37. The working space 33 is connected to the supply line 38 via a connecting line 36.

In the region of an upper end face 2' of the piston region of the valve stem 2, the cylinder guide 5 is adjacent a pressure space 20 which is connected to a further hydraulic volume 43 via a line 21. The pressure space 20 and hydraulic volume 43 together form an oil-pressure spring which is connected in series with a helical compression spring 45 loaded with pressure via a cylinder 44 and the hydraulic volume 43. The design and functioning of this hydraulic unit correspond to a hydraulic control device, such as is described in German Patent Application 196 21 951.5 not previously published, so that, for more detailed explanations, reference may be made to the disclosure in this patent application. The spring means designed in this way loads the valve stem 2 in the valve-opening direction, the pressure space 20 forming at the same time a lifting space for the valve stem 2.

The pressure space 20 is capable of being connected hydraulically, via ducts 11 and 14 running coaxially in the piston region of the valve stem 2, to the working space and from there, via the connecting line 36 designed as a delivery line, to the supply line 38, by virtue of the fact that a ball 17 mounted in a widening 19 of the duct 11 is deflected out of its position of rest illustrated in the drawings by a sufficient gradient between the pressure of the oil-pressure spring and the current supply pressure counter to the force of a prestressed compression spring 18 and the supply pressure loading the underside of the ball. This situation occurs when the supply pressure is lowered sharply, with a valve not completely extended. In this case, as explained, the oil-pressure spring is expanded to the supply pressure, whereupon the valve closes as a result of the force of the helical compression spring 4.

Figure 4:
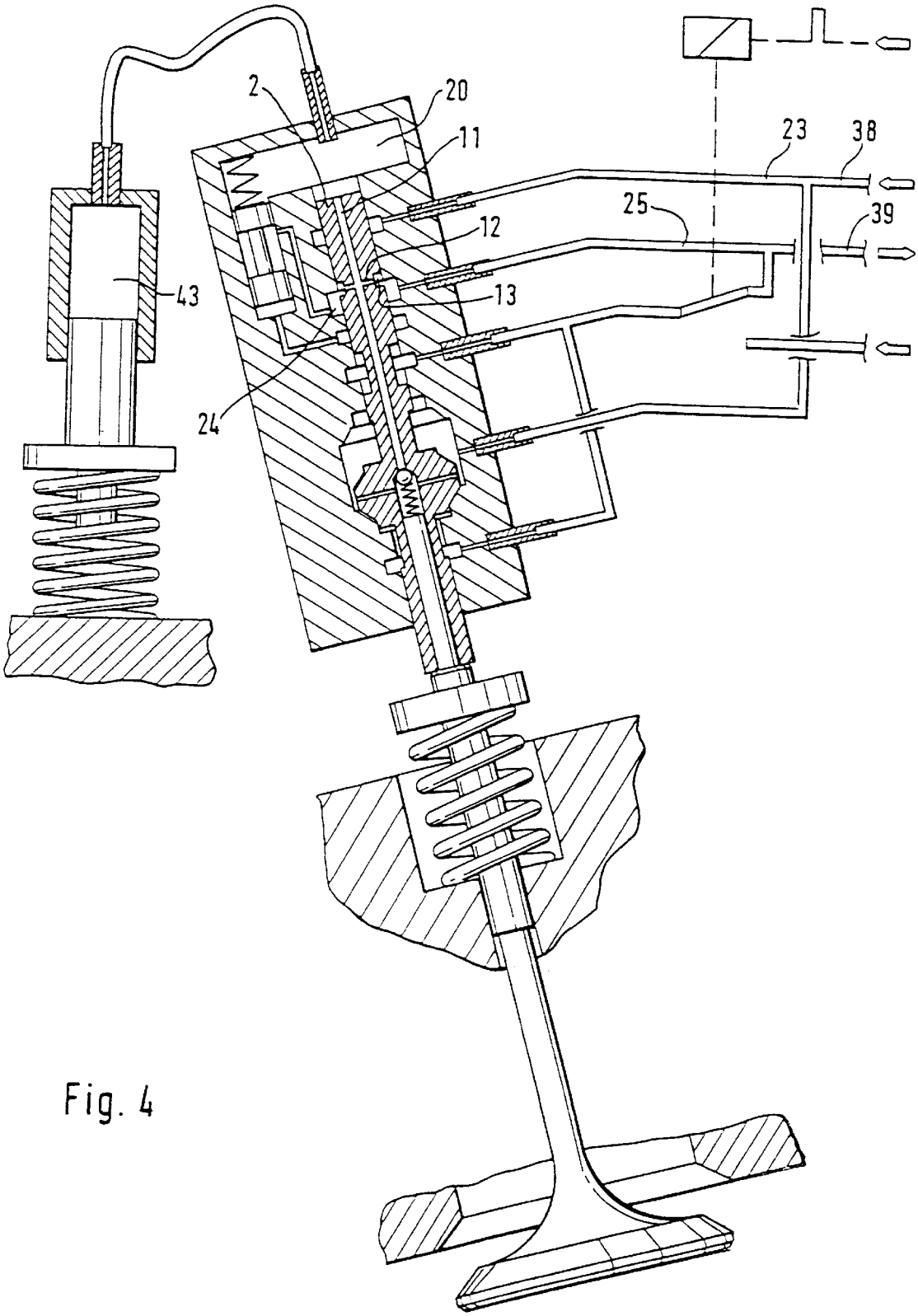
FIG. 4 is a view of the control device similar to FIG. 1 in which the lifting valve is opened completely (i.e., the lower end position).

As already mentioned, during a work cycle the piston region of the valve stem 2 and the control piston 7 move back and forth between two end positions. The pressure spaces 34 or 35 separated from the working space 33 by the plunger pistons 8 or 9 are capable of being connected alternately, in each case by grooves 15, 16 provided in the piston region of the valve stem 2 above and below the control piston 7, to the annular ducts 29, 31 which are connected to the connecting lines 30, 32. FIG. 1 shows, in this respect, the position of the valve stem 2 and of its piston region in an upper end position, in which the pressure space 35 is loaded via the groove 16 and the connecting line 30 is relieved of pressure. FIG. 4 illustrates the valve stem 2 and its piston region in the opposite lower end position, in which the pressure space 34 is loaded via the groove 15 and the delivery line 32 relieved of pressure.

In the end positions mentioned, the respectively pressure-relieved pressure space 34 or 35 can be loaded with the supply pressure by a change-over of the switching valve 46. Thereby, if the conditions of force are appropriately dimensioned, the lifting valve is moved out of its upper end position by the pressure of the oil-pressure spring on the end face 2' and out of its lower end position by the pressure of the compression spring 4 on the spring receptacle 3.

Figure 2:
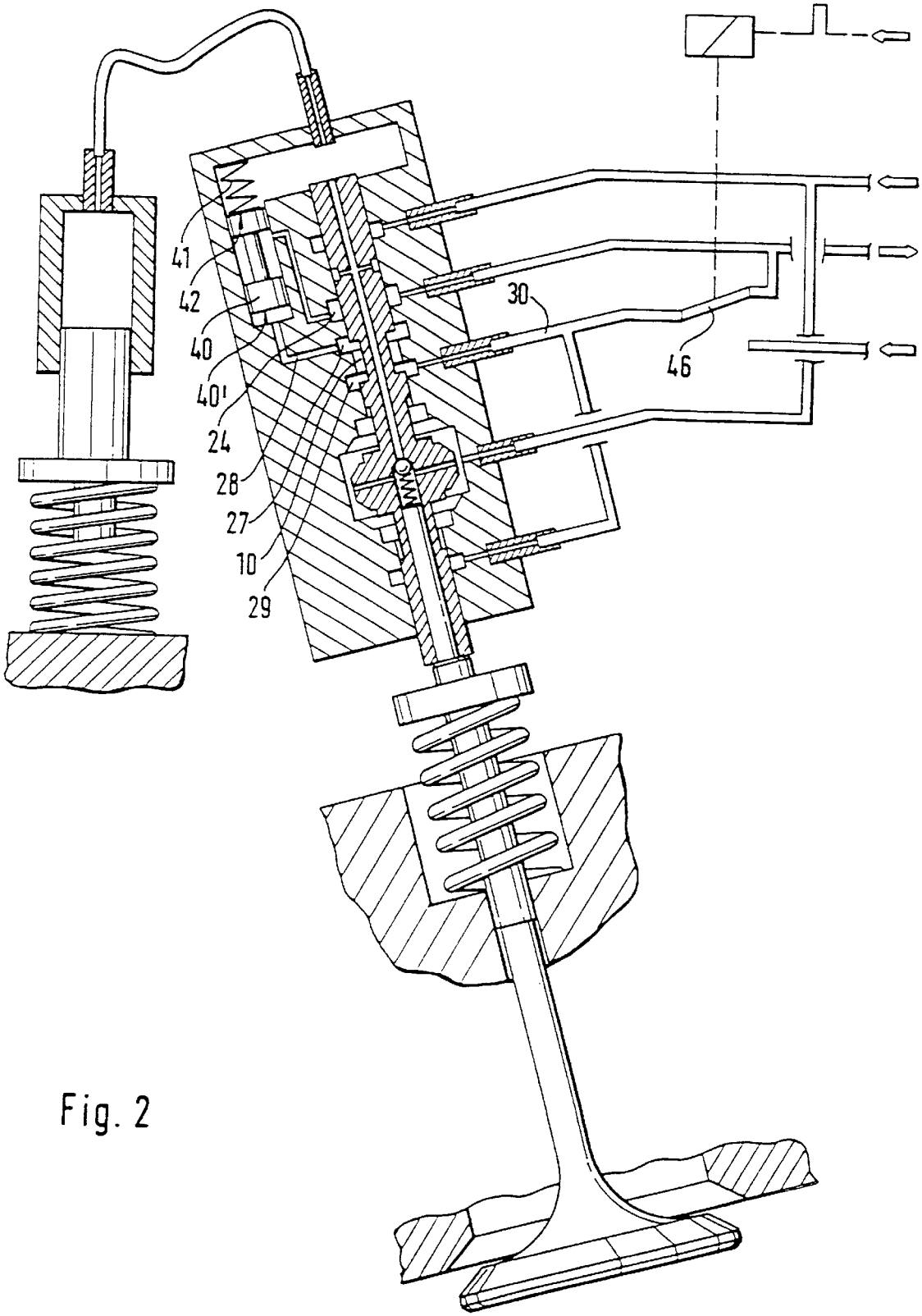
FIG. 2 is a view of the control device similar to FIG. 1 but when the lifting valve is in the middle position.

When the control piston 7 has been moved out of its end position to an extent such that the respective plunger piston 8 or 9 emerges from the associated pressure space 34 or 35, the associated annular duct 31 or 29 is shut off by the piston region of the valve stem 2, and the connecting lines 30 and 32 can be relieved of pressure by resetting the switching valve 46 into its position of rest illustrated in FIGS. 1, 2 and 4 and, consequently, by coupling the connecting lines to the return line 39.

In general, after movement has been triggered by the spring devices respectively stressed to a greater extent, the valve stem 2 is moved as far as the opposite end position. Functioning corresponds to the functioning of the control devices, such as are described in DE 195 01 495 C1 or DE 196 21 951.5. In this case, pressure loading takes place via the annular duct 22 in the cylinder guide 5, via an annular groove 13 serving as a control groove and via control ducts 11, 12 in the piston region of the valve stem 2.

When the lifting valve 1 is in the position shown in FIG. 4, the pressure in the pressure space 20, together with the hydraulic volume 43, is capable of being reduced again via the control ducts 11, 12, the control groove 13 and the annular duct 24, and also via the connecting line 25 and the return line 39. It thereby becomes easier for the lifting valve 1 to be capable of being reset into the position shown in FIG. 1, and any renewed pressure loading in the position of rest according to FIG. 1 becomes possible.

There is, however, the possibility that the piston region remains in the position shown in FIG. 2. This can be due to a malfunction, as a result of which the pressure of the oil-pressure spring may not be sufficiently high to move the piston region of the valve stem 2, starting from the position illustrated in FIG. 1, counter to the force of the helical compression spring 4 into the position illustrated in FIG. 4. This results in undefined activatibility of the piston region of the valve stem 2 and is detrimental to reliable functioning of the lifting valve 1.

For this reason, the pressure space 20 is assigned an auxiliary control member which is formed by a 2/2-way valve with a working space 37 and with a control slide 40, a control line 28, a restoring spring 41 and a connecting line 26. The pressure 20 and the working space 37 for the control slide 40 are connected hydraulically to one another, but the connection is broken by the control slide 40 when the latter is in the rest position. When the control slide 40 capable of being loaded on two sides is in the rest position, the restoring spring 41 is essentially expanded and the control line 28 is relieved of pressure. The connecting line 26 is relieved of pressure in any situation, because it is permanently connected to the connecting line 25 via the annular duct 24.

When the valve stem 2 is in an undefined middle position shown in FIG. 2, the control line 28 is connected to the connecting line 30 via the annular duct 27, a control groove 10 in the piston region of the valve stem 2 and the annular duct 29. The control line is capable of being loaded with the supply pressure as a result of the actuation of the switching valve 46. The pressure acting on one end face 40' of the control slide 40 causes the control slide 40 to be moved counter to the force of the restoring spring 41 into the position shown in FIG. 3.

Figure 3:
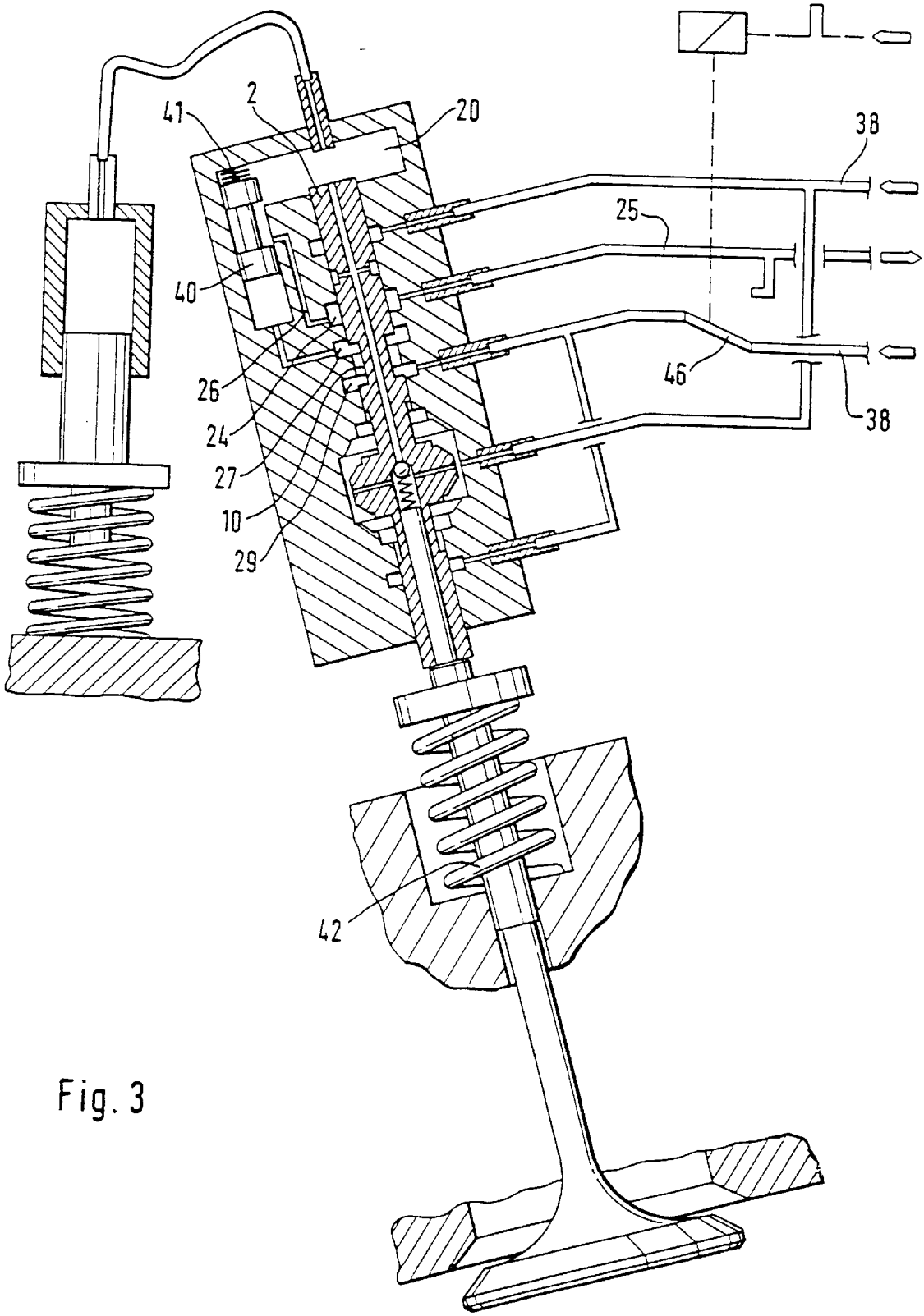
FIG. 3 is a view of the control device similar to FIG. 1 in its middle position, but with the movement for resetting the lifting valve being triggered.

As shown in FIG. 3, the activated auxiliary control member opens the connection between the pressure space 20 and the connecting line 26. As a result, the oil-pressure spring is relieved of pressure and the piston region of the valve stem 2 is pressed out of its middle position by the compression spring 4 back into the end position according to FIG. 1. When the lifting valve 1 has reached its upper end position, there is no longer a hydraulic connection between the annular ducts 27, 29 via the control groove 10. Instead, a connection of the annular ducts 27, 24 ensures that the control line 28 is relieved of pressure and therefore that the control slide 40 is reset into its position of rest by the force of the compression spring 41.

This may take place without any special regulation, in particular without a reduction in the supply pressure and without measuring procedures for detecting the exact position of the lifting valve 1. Moreover, if the control groove 10 and angular ducts 27, 29 are appropriately configured geometrically, the aim of this being to ensure that, when the piston 4 is in any middle position, the two annular ducts 27 and 29 are hydraulically connected to one another via the control groove 10, resetting can take place from any position of the lifting valve and also at any speed of the lifting valve, that is to say also during normal functioning.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Valve for use in an internal combustion engine, comprising a valve stem which is operatively assigned first spring apparatus acting in a valve-closing direction and second hydraulically regulated oil-pressure spring apparatus acting in a valve-opening direction and which is operatively connected to a control piston loaded hydraulically on two sides thereof, the valve being configured to be triggered to open and close by a central control unit actuator, wherein the second hydraulically regulated oil-pressure spring apparatus is operatively assigned a hydraulically acting auxiliary control member so that, in an actuating operation of the actuator in the closing direction of the valve when in any position, the second hydraulically regulated oil-pressure spring apparatus is relieved of compressive force thereof to below an actuating force of the first spring apparatus.

2. The valve according to claim 1, wherein the auxiliary control member is configured to function as a 2/2-way valve.

3. The valve according to claim 1, wherein the auxiliary control member is operatively connected to a pressure supply line and a pressure relief line configured to be loaded by the actuator.

4. The valve according to claim 1, wherein the auxiliary control member is arranged to be held in a rest position by a mechanical restoring spring.

* * * * *